US011255080B2

(12) United States Patent
Morris et al.

(10) Patent No.: US 11,255,080 B2
(45) Date of Patent: Feb. 22, 2022

(54) CLOSET FLANGE WITH A MEMBRANE SEAL

(71) Applicant: Charlotte Pipe and Foundry Company, Charlotte, NC (US)

(72) Inventors: William Boykin Morris, Blounts Creek, NC (US); Chase Speights, Locust, NC (US)

(73) Assignee: Charlotte Pipe and Foundry Company, Charlotte, NC (US)

( * ) Notice: Subject to any disclaimer, the term of this patent is extended or adjusted under 35 U.S.C. 154(b) by 0 days.

(21) Appl. No.: 16/896,433

(22) Filed: Jun. 9, 2020

(65) Prior Publication Data

US 2020/0392717 A1 Dec. 17, 2020

Related U.S. Application Data

(60) Provisional application No. 62/860,296, filed on Jun. 12, 2019.

(51) Int. Cl.
*E03D 11/16* (2006.01)

(52) U.S. Cl.
CPC ..... *E03D 11/16* (2013.01)

(58) Field of Classification Search
CPC ..... E03D 11/16; E03D 11/17; E03D 11/18
See application file for complete search history.

(56) References Cited

U.S. PATENT DOCUMENTS 3,677,434 A 7/1972 Boyer
3,856,050 A 12/1974 Rooney
3,942,681 A 3/1976 Richardson
3,996,966 A 12/1976 Princell
4,014,368 A 3/1977 Nelsen
4,212,486 A 7/1980 Logsdon
4,233,697 A 11/1980 Cornwall
4,602,504 A 7/1986 Barber
4,706,482 A 11/1987 Barber
4,763,510 A 8/1988 Palmer
4,915,137 A 4/1990 Hall et al.
5,265,752 A 11/1993 Olson
5,329,971 A 7/1994 Condon
5,377,361 A 1/1995 Piskula
5,503,189 A 4/1996 Lamendola
5,624,123 A 4/1997 Meyers
5,711,536 A 1/1998 Meyers
5,996,134 A 12/1999 Senninger
(Continued)

*Primary Examiner* — Janie M Loeppke

(74) *Attorney, Agent, or Firm* — Nelson Mullins Riley & Scarborough LLP

(57) ABSTRACT

A closet flange for use in installation of a toilet in relation to a waste pipe. The closet flange comprises a body formed of polymeric material, the body including a tubular portion having a proximal end and a distal end and a flange portion located at the proximal end of the tubular portion. The flange portion extends radially outward with respect to the tubular portion of the body, the flange portion defining an inner periphery forming a drain opening aligned with an interior of the tubular portion and further defining an outer periphery. The flange portion also defines a plurality of fastener openings therethrough for use in securing the closet flange to a mounting surface. A seal membrane is removably attached to the flange portion so as to cover the drain opening in a water-tight manner.

20 Claims, 7 Drawing Sheets

(56) References Cited

U.S. PATENT DOCUMENTS

| | | | | |
|---|---|---|---|---|
| 6,032,515 | A | 3/2000 | Huber | |
| 6,085,362 | A | 7/2000 | Huber | |
| 6,739,597 | B2 | 5/2004 | Nicolia et al. | |
| 6,915,819 | B2 | 7/2005 | Duncan | |
| 7,055,184 | B2 | 6/2006 | Humber | |
| 7,343,936 | B2 | 3/2008 | Collins et al. | |
| 7,665,486 | B2 | 2/2010 | Coscarella | |
| 8,069,502 | B2 | 12/2011 | Coronado | |
| 8,099,801 | B2 | 1/2012 | Hughes | |
| 8,118,091 | B2 | 2/2012 | Baker et al. | |
| 8,245,732 | B2 | 8/2012 | Coscarella | |
| 8,281,421 | B2 | 10/2012 | Hughes | |
| 8,443,844 | B2 | 5/2013 | Zeyfang | |
| 8,646,314 | B2 | 2/2014 | Coscarella | |
| 8,671,991 | B2 | 3/2014 | Zeyfang | |
| 8,898,823 | B2 | 12/2014 | McHugh, III | |
| 9,074,377 | B2 | 7/2015 | Wood | |
| 9,091,076 | B2 | 7/2015 | Amer et al. | |
| 9,249,586 | B2 | 2/2016 | Wood | |
| 9,506,258 | B2 | 11/2016 | Amer et al. | |
| 9,816,261 | B2 | 11/2017 | Schuster | |
| 9,869,081 | B1 | 1/2018 | Pardo, Jr. | |
| 9,970,587 | B2 | 5/2018 | Armenta | |
| 10,041,242 | B2 | 8/2018 | Yssel | |
| 2003/0159203 | A1 | 8/2003 | Hoover | |
| 2005/0138722 | A1* | 6/2005 | Humber | E03D 11/16 4/252.1 |
| 2009/0007320 | A1* | 1/2009 | Guo | E03D 11/16 4/252.6 |
| 2010/0123307 | A1* | 5/2010 | Coronado | E03D 11/16 285/56 |
| 2012/0240319 | A1* | 9/2012 | Yssel | E03D 11/16 4/252.1 |
| 2012/0261024 | A1 | 10/2012 | Ketzer | |
| 2013/0227772 | A1* | 9/2013 | Schuster | E03D 11/17 4/300 |
| 2017/0237243 | A1 | 8/2017 | Brey | |
| 2018/0142456 | A1 | 5/2018 | Condon et al. | |

* cited by examiner

CLOSET FLANGE WITH A MEMBRANE SEAL

CROSS-REFERENCE TO RELATED APPLICATION

This application claims priority from U.S. provisional patent application No. 62/860,296, filed Jun. 12, 2019, the entire contents of which are incorporated herein by reference.

FIELD OF THE INVENTION

The present invention relates generally to closet flanges used with household toilets.

BACKGROUND OF THE INVENTION

A "closet flange" (sometimes called a "toilet flange") is used to connect and secure a toilet to a building's plumbing system. Generally, closet flanges have a radial flange portion located at the proximal end of a tubular portion. Typically, closet flanges are produced from metals such as cast iron or brass, or plastics such as polyvinyl chloride (PVC) or acrylonitrile butadiene styrene (ABS).

Plastic closet flanges are bolted to the floor/subfloor of the building in alignment with the end of a waste pipe. The tubular portion of the closet flange is commonly attached to the waste pipe using solvent cement to chemically weld the closet flange and the waste pipe together. Closet flanges are usually installed during rough-in installation, and the plumbing system must be tested, typically hydrostatically tested, prior to installation of the plumbing fixtures. A typical building code might require that the plumbing system be free of leaks under 10 feet of head at 4.3 psi for 15 minutes.

In order to test the system, the closet flanges (and all system openings) must be plugged or capped. This is typically accomplished by installing a test ball or using a "knock out" closet flange that has a thin, molded piece of plastic that seals off the closet flange opening. When a knock-out closet flange is used, the knock-out piece is removed such as by hitting it with a hammer.

The use of a knock-out closet flange presents several issues. For example, the knock-out piece is often difficult to remove and requires tools to hit and/or pry it out. Sometimes, the knock-out piece does not breakaway flush but will instead break into multiple random pieces. These pieces can fall down into the plumbing drainage system which can cause blockages. In addition, removal of the knock-out piece can create sharp edges in the closet flange opening, which might eventually cause a flow obstruction to the toilet or may cause the installer's hands to be cut. Damage to the remaining body of the closet flange may also occur when the knock-out piece is removed. Finally, if the knock-out piece is molded too thin, it may not have sufficient strength to hold a test (i.e., it may leak).

SUMMARY OF THE INVENTION

The present invention recognizes and addresses the foregoing considerations, and others, of prior art constructions and methods.

According to one aspect, the present invention provides a closet flange for use in installation of a toilet in relation to a waste pipe. The closet flange comprises a body formed of polymeric material, the body including a tubular portion having a proximal end and a distal end and a flange portion located at the proximal end of the tubular portion. The flange portion extends radially outward with respect to the tubular portion of the body, the flange portion defining an inner periphery forming a drain opening aligned with an interior of the tubular portion and further defining an outer periphery. The flange portion also defines a plurality of fastener openings therethrough for use in securing the closet flange to a mounting surface. A seal membrane is removably attached to the flange portion so as to cover the drain opening in a water-tight manner.

In an exemplary embodiment, the body is formed of PVC material and the seal membrane is formed of a fabric material weldable to PVC. For example, the seal membrane may be formed of PVC fabric and welded to the flange portion about the drain opening.

In an exemplary embodiment, the flange portion may define an annular recess circumscribing the drain opening in which an annular ridge is situated, the seal membrane being welded to the flange portion at the annular ridge. The seal membrane may be welded to the flange portion radially inside of the plurality of fastener openings. In addition, the seal membrane may be sized to cover at least some of the fastener openings. Preferably, the seal membrane may further define a pull tab to facilitate its removal from the body in a peeling action.

According to another aspect, the present invention provides a closet flange for use in installation of a toilet in relation to a waste pipe. The closet flange comprises a body formed of polymeric material, the body including a tubular portion having a proximal end and a distal end and a flange portion located at the proximal end of the tubular portion. The flange portion extends radially outward with respect to the tubular portion of the unitary body and defines an inner periphery forming a drain opening aligned with an interior of the tubular portion and further defines an outer periphery. The flange portion further defines a plurality of fastener openings therethrough for use in securing the closet flange to a mounting surface. A seal membrane formed of a flexible fabric material is also provided. The seal membrane is welded to the flange portion at an annular weld seam about the drain opening so as to cover the drain opening in a water-tight manner.

A still further aspect of the present invention provides a method of installing a toilet to a mounting surface defining an opening at which an end of a waste pipe is located. The method involves providing a closet flange including a tubular portion having a proximal end and a distal end. A flange portion is located at the proximal end of the tubular portion and defines a drain opening. A seal membrane formed of a flexible fabric material is welded to the flange portion at an annular weld seam about the drain opening so as to cover the drain opening in a water-tight manner. A tubular portion of the closet flange is slidably positioned on an outer surface of the waste pipe. The seal membrane is removed from the flange portion to open the drain opening. The flange portion of the closet flange is secured to the mounting surface. A ring gasket is positioned at a drain opening defined in the flange portion of the closet flange. The toilet is positioned with respect to the mounting surface such that a drain of the toilet will be circumscribed by the ring gasket.

These and other novel aspects, features and advantages of the present invention will be apparent from the following disclosure of a preferred embodiment of the invention as depicted in the accompanying drawings.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
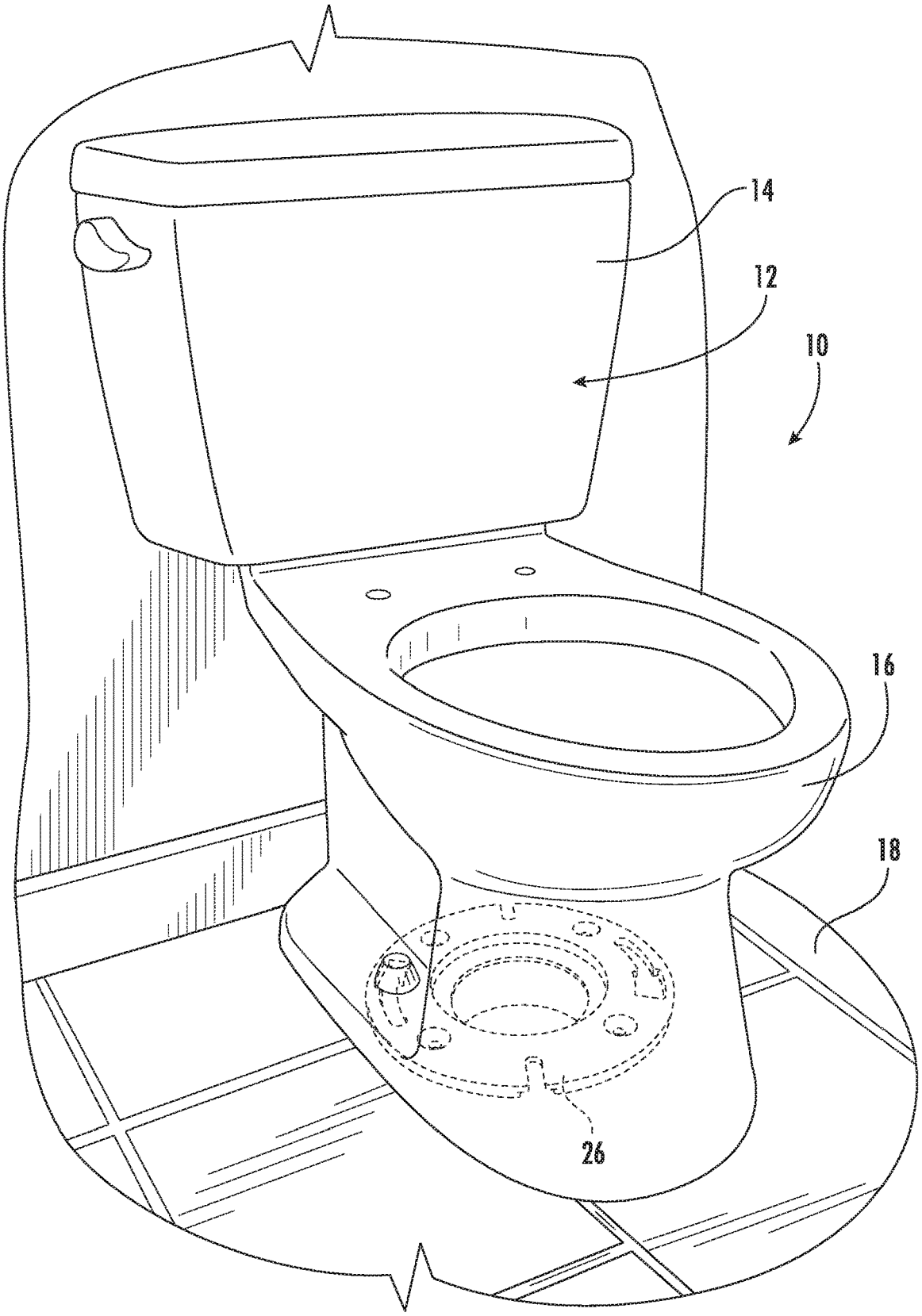
FIG. 1 is a perspective view showing a toilet assembly utilizing an improved closet flange in accordance an embodiment of the present invention.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, any usage of the terms "pipe" and the "end" of a pipe are intended to be understood and interpreted, in their broadest generic sense not inconsistent with but not limited to any common industry usage. A "pipe" is used herein to encompass any tubular structure capable of fluid conveyance therethrough and an "end" of a pipe is any termination of the tubular structure defining an opening through which fluid enters or exits the pipe. A "pipe" may be linear (straight) or non-linear (e.g., curvilinear) in the direction of fluid conveyance, and may be of differing transverse cross-sectional shapes, often round but not necessarily cylindrical or uniform in transverse cross-section. Pipes include for example tubular structures with uniform inner and outer diameters defining a cylindrical tubular structure, as are often commonly referred to as pipes, but also include other tubular components.

Figure 2:
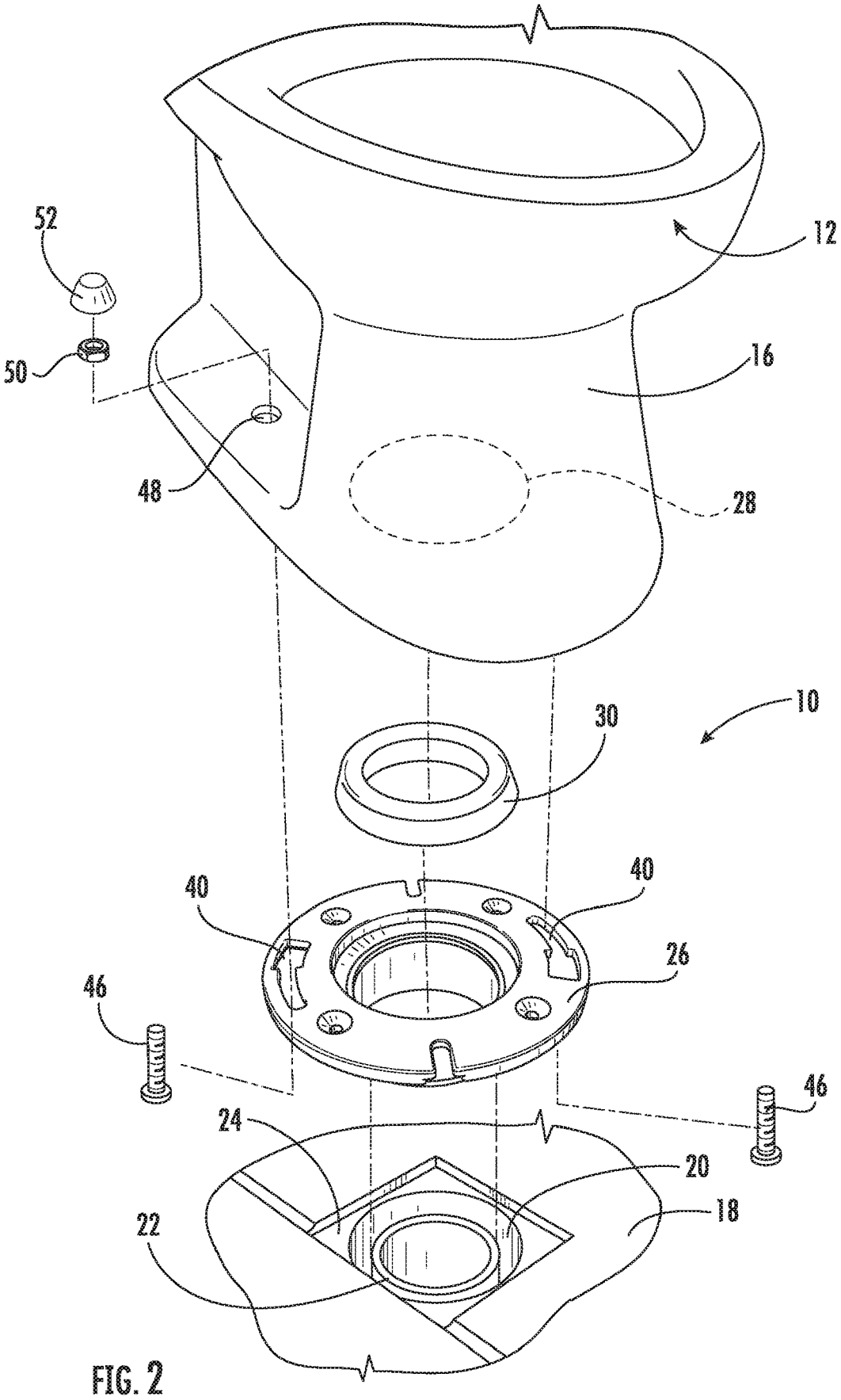
FIG. 2 is a perspective exploded view of the toilet assembly of FIG. 1 showing various component parts including the improved closet flange.

FIGS. 1 and 2 illustrate a toilet assembly 10 in accordance with an embodiment of the present invention. As shown, assembly 10 includes a toilet 12 which is in this example a conventional two-piece toilet having a tank 14 and a base 16. Base 16 is secured to a floor 18, such as in the bathroom of a residence. As can be seen most clearly in FIG. 2, floor 18 defines a hole 20 exposing the end of a waste pipe 22. In this example, floor 18 is tiled and the end of waste pipe 22 is cut to be flush with or slightly below the subfloor 24. Note that the hole 20 provides an annular gap around the outer surface of waste pipe 22. A closet flange 26 is secured to floor 18 (or to subfloor 24), typically using bolts, in order to interface the drain 28 of toilet 12 with waste pipe 22. A seal gasket 30, e.g., a conventional wax seal, is located between toilet 12 and closet flange 26 to seal the space therebetween. At least a portion of seal gasket 30 is located around (i.e., circumscribes) the drain 28.

Figure 3:
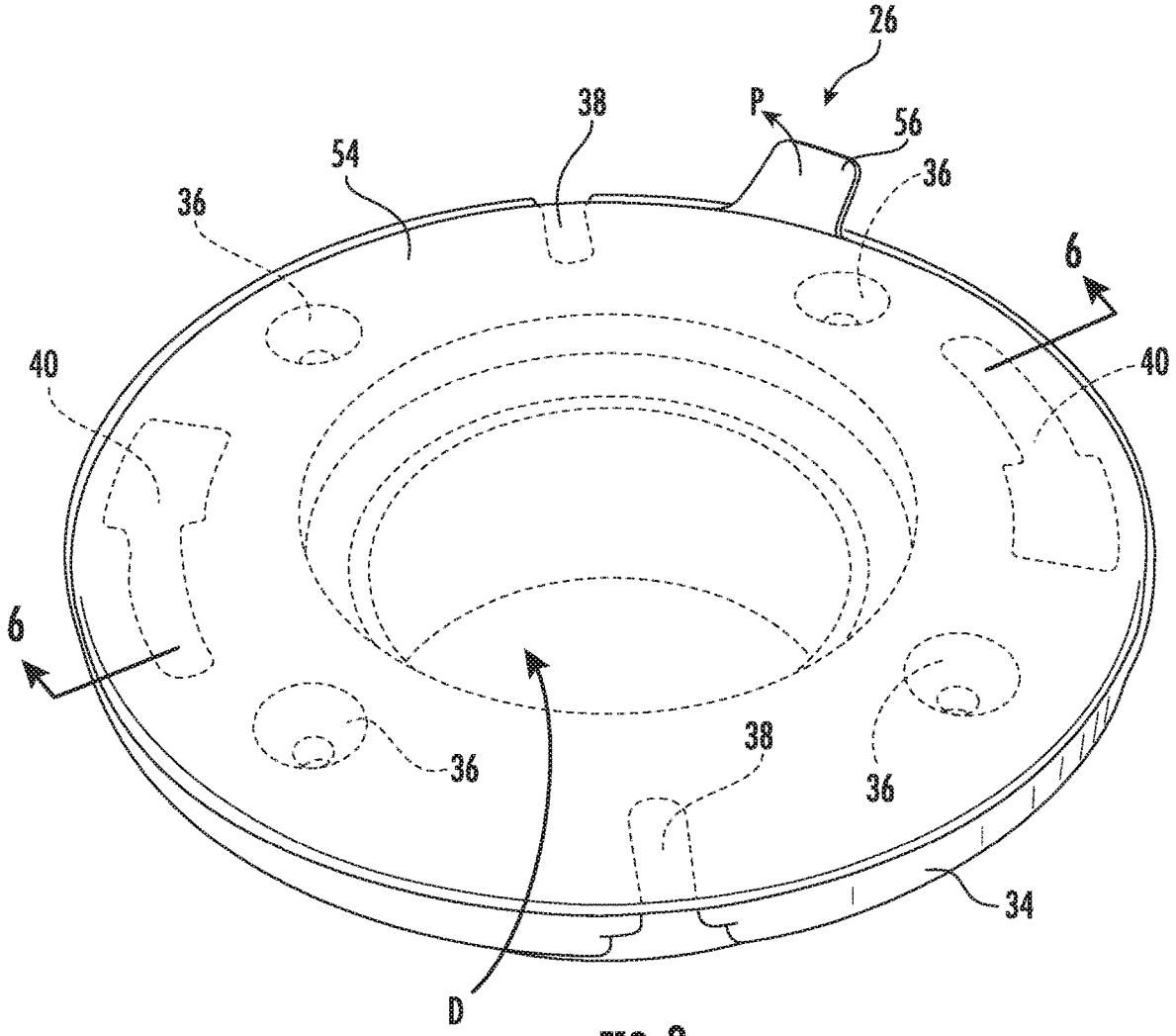
FIG. 3 is a perspective view of an improved closet flange in accordance with an embodiment of the present invention with the sealing membrane in place.
Figure 4:
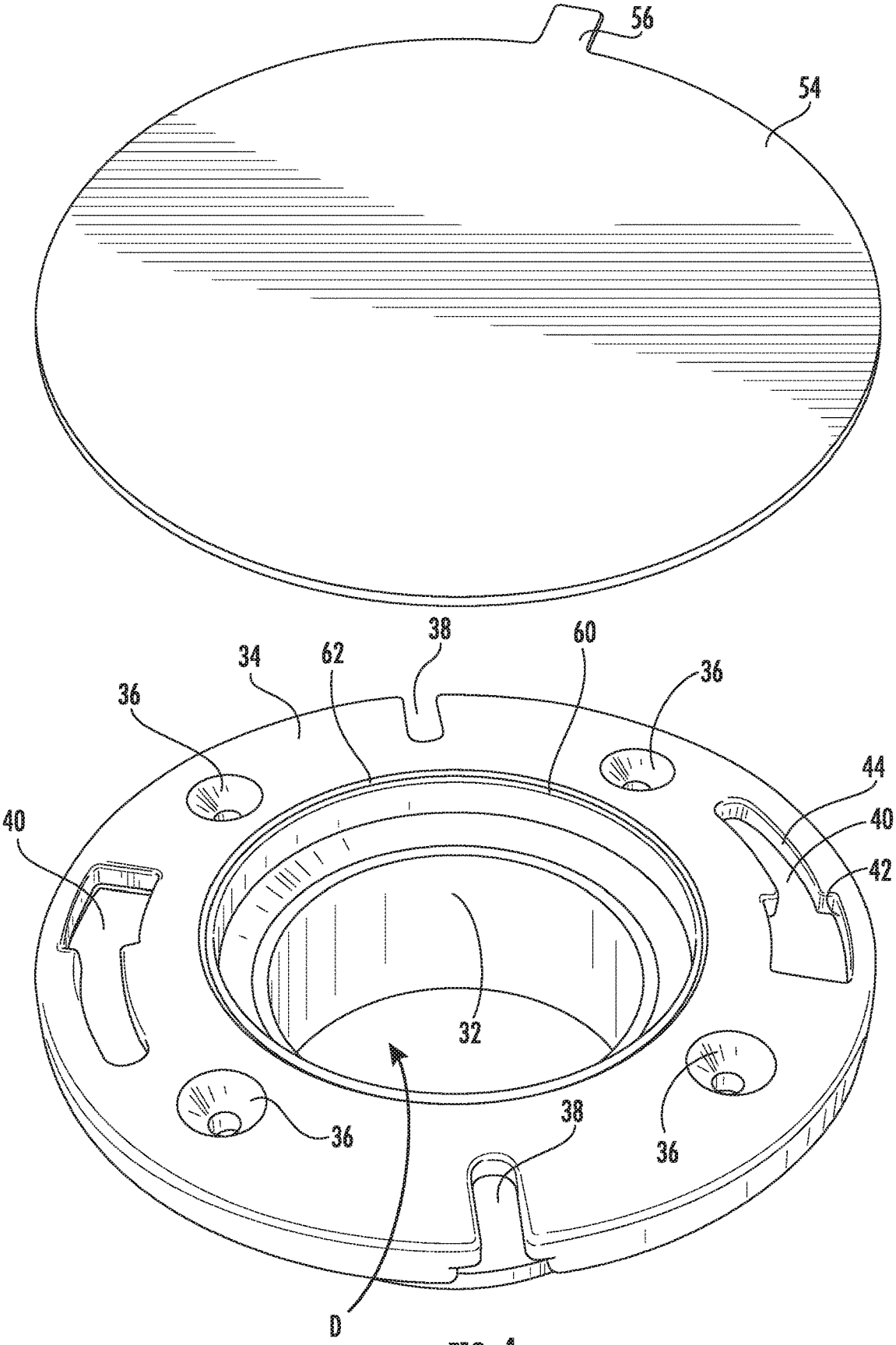
FIG. 4 is a perspective exploded view of the closet flange of FIG. 3.

Referring now also to FIGS. 3 and 4, the body of closet flange 26 has a tubular portion 32 (which can also be called a "hub portion") with a proximal end and a distal end. A flange portion 34 is located at and extends radially from the proximal end of tubular portion 32. Together, tubular portion 32 and flange portion 34 define a drain opening D. It will be appreciated that the body of closet flange 26 may be formed of any suitable material. In this embodiment, for example, the body of closet flange 26 is unitarily formed from PVC. Embodiments are contemplated in which the body is formed of ABS or another suitable material (e.g., a suitable polymeric material).

The inner diameter of tubular portion 32 is sized to receive the end of waste pipe 22. Thus, when closet flange 26 is installed, tubular portion 32 is inserted into the gap of hole 20 surrounding the outer surface of waste pipe 22. Flange portion 34 preferably defines openings, such as holes 36 and/or slots 38, for receipt of fasteners (e.g., bolts) for securing closet flange 26 to the mounting surface (i.e., floor 18 in this case).

Flange portion 34 further defines two diametrically-opposed arcuate slots 40, each having a widened insertion portion 42 and a narrower retention portion 44. As can be explained most easily with reference to FIG. 2, widened insertion portion 42 allows the head of a respective toilet bolt 46 to be inserted into slot 40. The toilet bolt 46 is then moved along slot 40 until the bolt head is position under and retained by retention portion 44. Toilet 12 is positioned such that the shanks of toilet bolts 46 extend through respective lateral holes (e.g., hole 48) in the base 16 of the toilet 12. Washers and nuts (e.g., nut 50) are used to secure toilet 12 with respect to closet flange 26. The ends of toilet bolts 46 may be covered with a decorative cap such as cap 52.

As shown in FIG. 3, closet flange 26 is equipped with a membrane seal 54 attached to the body of closet flange 26 to cover drain opening D. Seal 54 is attached in a water-tight manner that allows testing of the overall plumbing system for leaks in lieu of a test ball or knock-out piece as described above. Thus, seal 54 will typically remain in place after installation of the closet flange 26 to the mounting surface (e.g., floor 18) at least until testing is performed. Seal 54 is removed in a peel-off fashion (as indicated by arrow P) when the toilet 12 is installed. In this regard, seal 54 may include a tab portion 56 which a user may grasp to facilitate the removal process.

In a preferred embodiment, seal 54 comprises a disc of a suitable flexible fabric material which is appropriately impermeable to fluid. For example, seal 54 may be formed of a polymeric material or other fabric material that is compatible with the material of the body of closet flange 26, preferably a polymeric material or other fabric material without a plasticizer. Non-limiting examples of such polymeric or other fabric materials include, but are not limited to, a PVC containing fabric. In this case, seal 54 is adhered to flange portion 34 at an annular attachment location 58 (FIG. 5) that continuously circumscribes drain opening D, but is radially inside of holes 36. As shown, seal 54 may have an outer diameter approximately the same as the outer periphery of flange portion 34. In this way, the portion of seal 54 radially outside of attachment location 58 may be gently lifted by a user to access holes 36 without removing seal 54. In this way, closet flange 26 can be attached to the floor but seal 54 remains in place for subsequent leak testing of the plumbing system. In addition, seal 54 tends to prevent grout or other construction material from entering holes 36, slots 38, and slots 40.

As one skilled in the art will appreciate, PVC fabric generally utilizes a suitable woven core which has been coated with PVC to add strength and fluid impermeability. A PVC fabric is advantageous where the flange body is formed of PVC because of the similarity of the materials of the components. For example, a suitable adhesive that adheres to PVC might be used to form the attachment location 58. In this embodiment, however, attachment location 58 is formed as a welded seam, e.g., by sonic welding, whereby material of flange portion 34 and material of seal 54 are fused together.

Figure 5:
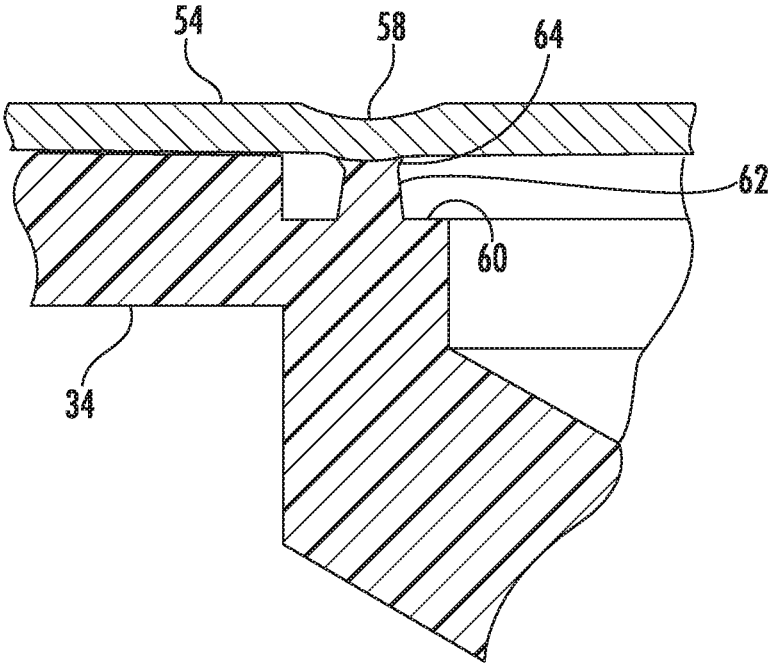
FIG. 5 is an enlarged cross-sectional fragmentary view showing the manner in which the membrane seal may be attached to the body of the closet flange in accordance with a preferred embodiment.
Figure 6:
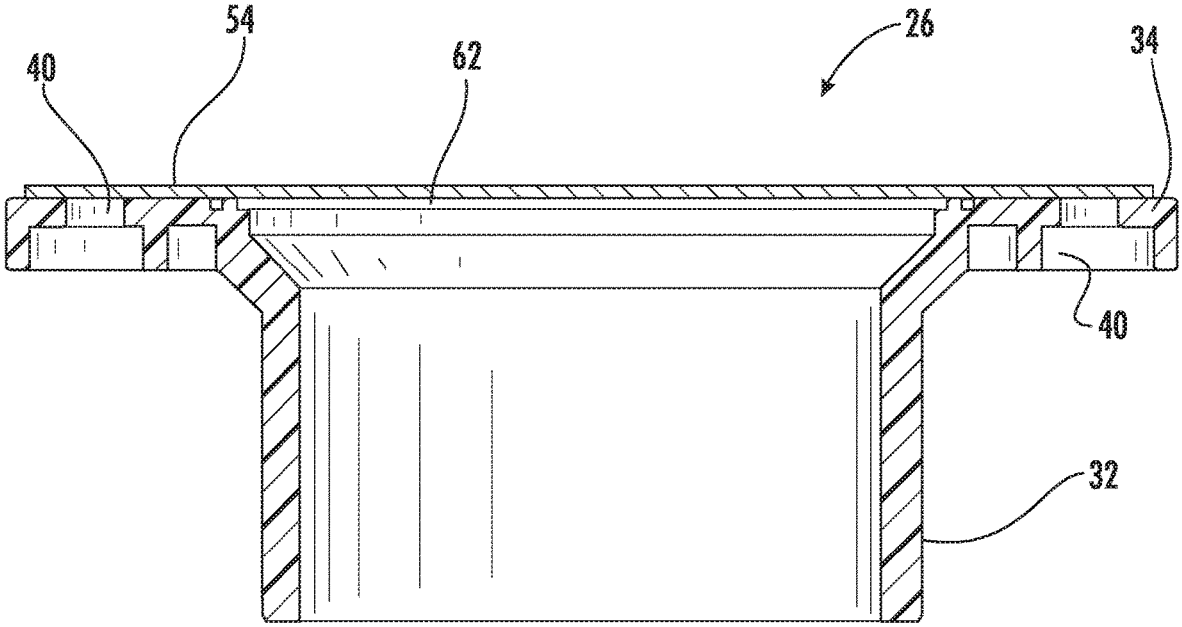
FIG. 6 is a cross-sectional view taken along line 6-6 of FIG. 3.

Referring now particularly to FIGS. 4-6, additional detail regarding the attachment of seal 54 to flange portion 34 can be most easily explained. As can be seen, closet flange 26 in this embodiment defines an annular recess 60 around drain opening D. An annular ridge 62 extends up from the floor of recess 60 to a height approximately flush with the top surface of flange portion 34. Seal 54 is welded to ridge 62, as indicated at 64 (FIG. 5), in order to attach seal 54 to flange portion 34 (thereby forming attachment location 58). This will create a fluid tight attachment as desired. At the same time, seal 54 is easily removable due to the relatively narrow width of ridge 62.

Figure 7:
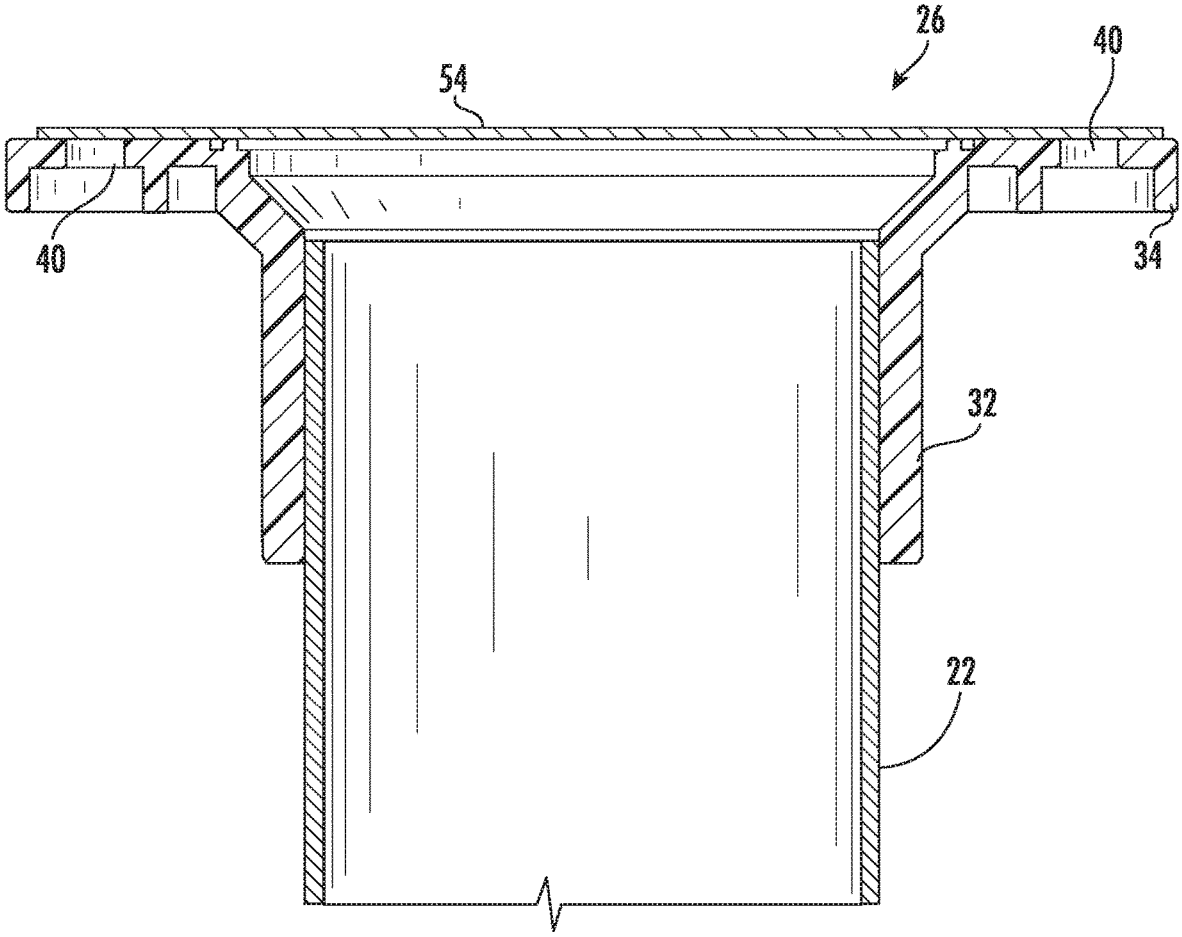
FIG. 7 is a view similar to FIG. 6 but showing the closet flange installed on a bathroom waste pipe.

FIG. 7 shows the closet flange 26 positioned on the end of waste pipe 22 with membrane seal 54 in place. Typically, a PVC cement may be used to adhere the inside surface of tubular portion 32 to the outer surface of waste pipe 22. In this way, the plumbing system can be leak tested as described above before removal of seal 54.

Those skilled in the art will readily understand that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications, and equivalent arrangements, the present invention being limited only by the claims appended hereto and equivalents thereof.

What is claimed is:

1. A closet flange for use in installation of a toilet in relation to a waste pipe, said closet flange comprising:

a body formed of polymeric material, said body including a tubular portion having a proximal end and a distal end and a flange portion located at said proximal end of said tubular portion;

said flange portion extending radially outward with respect to said tubular portion of said body, said flange portion defining an inner periphery forming a drain opening aligned with an interior of said tubular portion and further defining an outer periphery;

said flange portion defining a plurality of fastener openings therethrough for use in securing said closet flange to a mounting surface; and a flexible fabric seal membrane removably attached to said flange portion so as to cover said drain opening in a water-tight manner.

2. The closet flange as set forth in claim 1, wherein said body is formed of PVC material and said seal membrane is formed of a fabric material weldable to PVC.

3. The closet flange as set forth in claim 2, wherein said seal membrane is formed of PVC fabric.

4. The closet flange as set forth in claim 2, wherein said seal membrane is welded to said flange portion about said drain opening.

5. The closet flange as set forth in claim 4, wherein said flange portion defines an annular recess circumscribing said drain opening in which an annular ridge is situated, said seal membrane being welded to said flange portion at said annular ridge.

6. The closet flange as set forth in claim 4, wherein said seal membrane is welded to said flange portion radially inside of said plurality of fastener openings.

7. The closet flange as set forth in claim 6, wherein said seal membrane is sized to cover at least some of said fastener openings.

8. The closet flange as set forth in claim 7, wherein said seal membrane further defines a pull tab to facilitate its removal from the body in a peeling action.

9. The closet flange as set forth in claim 8, wherein said seal membrane is formed of PVC fabric.

10. The closet flange as set forth in claim 1, wherein said body is formed of acrylonitrile butadiene styrene (ABS).

11. A closet flange for use in installation of a toilet in relation to a waste pipe, said closet flange comprising:

a body formed of polymeric material, said body including a tubular portion having a proximal end and a distal end and a flange portion located at said proximal end of said tubular portion;

said flange portion extending radially outward with respect to said tubular portion of said body, said flange portion defining an inner periphery forming a drain opening aligned with an interior of said tubular portion and further defining an outer periphery;

said flange portion defining a plurality of fastener openings therethrough for use in securing said closet flange to a mounting surface; and a seal membrane formed of a flexible fabric material, said seal membrane being welded to said flange portion at an annular weld seam about said drain opening so as to cover said drain opening in a water-tight manner.

12. The closet flange as set forth in claim 11, wherein said body is formed of PVC material and said seal membrane is formed of PVC fabric.

13. The closet flange as set forth in claim 11, wherein said body is formed of acrylonitrile butadiene styrene (ABS).

14. The closet flange as set forth in claim 11, wherein said flange portion defines an annular recess circumscribing said drain opening in which an annular ridge is situated, said seal membrane being welded to said flange portion at said annular ridge.

15. The closet flange as set forth in claim 14, wherein said seal membrane is welded to said flange portion radially inside of said plurality of fastener openings.

16. The closet flange as set forth in claim 15, wherein said seal membrane is sized to cover at least some of said fastener openings.

17. The closet flange as set forth in claim 16, wherein said seal membrane further defines a pull tab to facilitate its removal from the body in a peeling action.

18. A method of installing a toilet to a mounting surface defining an opening at which an end of a waste pipe is located, said method comprising steps of:

(a) providing a closet flange including:

a tubular portion having a proximal end and a distal end;

a flange portion located at said proximal end of said tubular portion and defining a drain opening; and a seal membrane formed of a flexible fabric material, said seal membrane being welded to said flange portion at an annular weld seam about said drain opening so as to cover said drain opening in a water-tight manner;

(b) slidably positioning said tubular portion of said closet flange on an outer surface of said waste pipe;

(c) securing said flange portion of said closet flange to said mounting surface;

(d) removing said seal membrane from said flange portion to open said drain opening; and (e) positioning a ring gasket at a drain opening defined in said flange portion of said closet flange; and (f) positioning the toilet with respect to the mounting surface such that a drain of the toilet will be circumscribed by said ring gasket.

19. The method as set forth in claim 18, wherein step (f) occurs after step (e).

20. The method as set forth in claim 18, wherein step (e) occurs after step (f).

* * * * *